US012798740B2

(12) United States Patent
Kimura et al.

(10) Patent No.: US 12,798,740 B2
(45) Date of Patent: Nov. 17, 2026

(54) UNDERWATER ENERGY TRANSFER SYSTEM

(71) Applicant: TOYOTA JIDOSHA KABUSHIKI KAISHA, Toyota (JP)

(72) Inventors: Kazutaka Kimura, Mishima (JP); Hiroyuki Nakatani, Gotemba (JP); Masahiro Takahashi, Nagakute (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 148 days.

(21) Appl. No.: 19/007,889

(22) Filed: Jan. 2, 2025

(65) Prior Publication Data

US 2025/0296668 A1 Sep. 25, 2025

(30) Foreign Application Priority Data

Mar. 22, 2024 (JP) ..... 2024-046225

(51) Int. Cl.
*B63G 8/00* (2006.01)

(52) U.S. Cl.
CPC ..... *B63G 8/001* (2013.01); *B63G 2008/002* (2013.01); *B63G 2008/008* (2013.01)

(58) Field of Classification Search
CPC ..... B63G 8/00; B63G 8/001; B63G 8/002; B63G 2008/002; B63G 2008/008
See application file for complete search history.

(56) References Cited

U.S. PATENT DOCUMENTS

| | | | | |
|---|---|---|---|---|
| 6,854,410 | B1 * | 2/2005 | King | G01S 15/88 114/244 |
| 2009/0114140 | A1 * | 5/2009 | Guerrero | B63C 11/52 114/321 |
| 2021/0188104 | A1 | 6/2021 | Mukaida et al. | |

FOREIGN PATENT DOCUMENTS

| | | | | |
|---|---|---|---|---|
| JP | H10-278874 | A | 10/1998 | |
| JP | 2019-217796 | A | 12/2019 | |
| NO | 317224 | B1 * | 9/2004 | E21B 41/04 |

* cited by examiner

*Primary Examiner* — Stephen P Avila
(74) *Attorney, Agent, or Firm* — Oliff PLC

(57) ABSTRACT

An underwater energy transfer system includes an attachment control unit and a navigation control unit. The attachment control unit includes an empty tank attachment unit provided in the second position and configured to mount the aerial tank to the underwater navigation body, and a filled tank attachment unit configured to release the aerial tank from the underwater navigation body and mount the filling tank to the underwater navigation body when the underwater navigation body arrives at the first position. The navigation body control unit includes a first navigation unit that causes the underwater navigation body to navigate to the first position to which the air tank is attached, and a second navigation unit that causes the underwater navigation body to navigate to the second position to which the filling tank is attached.

5 Claims, 9 Drawing Sheets

UNDERWATER ENERGY TRANSFER SYSTEM

CROSS-REFERENCE TO RELATED APPLICATION

This application claims priority to Japanese Patent Application No. 2024-046225 filed on Mar. 22, 2024, incorporated herein by reference in its entirety.

BACKGROUND

1. Technical Field

The present disclosure relates to an energy transfer system for transferring electric energy generated using renewable energy.

2. Description of Related Art

As a method for transferring energy in the sea, there is known a method in which an energy supply side and a demand side are connected by an oil supply hose underwater and oil is sent by the oil supply hose (see, for example, Japanese Unexamined Patent Application Publication No. 10-278874 (JP 10-278874 A)).

SUMMARY

In the above transfer method, however, the positional relationship between the energy supply side and the demand side is limited by the oil supply hose. Therefore, the degree of freedom is low. In addition, there are various technical problems, for example, in that it is not expected that energy is transferred in the form of a heavy solid such as a hydrogen storage alloy that stores hydrogen.

An object of the present disclosure is to provide an underwater energy transfer system that realizes a high degree of freedom and stable energy transfer.

An underwater energy transfer system according to an aspect of the present disclosure is an underwater energy transfer system configured to move a storage tank by an underwater navigation body including a tank attachment portion to and from which the storage tank is attachable and detachable between a first position where a filled storage tank that is the storage tank filled with predetermined energy waits for collection and a second position where the filled storage tank is to be collected. The underwater energy transfer system includes: an attachment control unit configured to control an operation of the tank attachment portion; and a navigation control unit configured to cause the underwater navigation body to navigate underwater. The attachment control unit includes an empty tank attachment unit configured to attach, to the tank attachment portion, an empty storage tank that is the storage tank prepared at the second position before being filled with the energy, and a filled tank attachment unit configured to, when the underwater navigation body arrives at the first position, release the empty storage tank from the tank attachment portion and attach the filled storage tank to the tank attachment portion. The navigation control unit includes a first navigation unit configured to cause the underwater navigation body to which the empty storage tank is attached to navigate to the first position, and a second navigation unit configured to cause the underwater navigation body to which the filled storage tank is attached to navigate to the second position.

In the underwater energy transfer system according to the aspect of the present disclosure, the first navigation unit can cause the underwater navigation body to which the empty storage tank is attached to navigate to the first position where the filled storage tank waits for collection. At the first position, the filled tank attachment unit can attach the filled storage tank to the underwater navigation body in place of the empty storage tank. Further, the second navigation unit can cause the underwater navigation body to which the filled storage tank is attached to navigate to the second position where the filled storage tank is to be collected. Thus, in the underwater energy transfer system, the storage tank is transported by the underwater navigation body navigating underwater. Therefore, the distance between the first position of the filled storage tank to be collected and the second position where the filled storage tank is to be collected is long, and the degree of freedom in settings of the positions is high. The storage tank is transported underwater. Thus, buoyancy can be utilized and stable energy transfer can be realized without being affected by the environment on the water surface (e.g., wind or waves). Accordingly, the present disclosure can provide the underwater energy transfer system that realizes a high degree of freedom and stable energy transfer.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

1. First Embodiment

Figure 1:
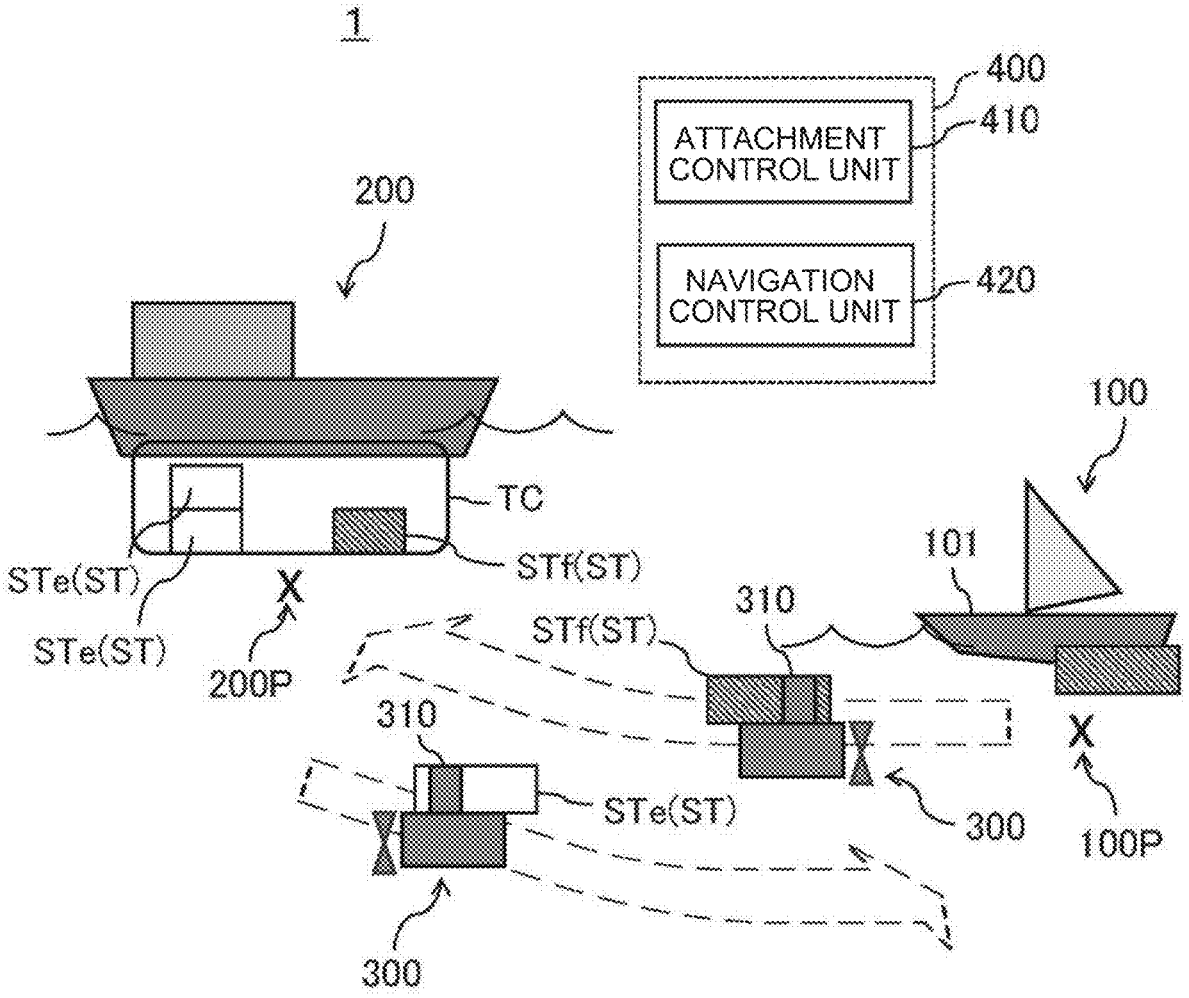
FIG. 1 is a schematic diagram of an example of an underwater energy transfer system.

First, an outline of the underwater energy transfer system 1 according to the present disclosure will be described with reference to FIG. 1. The underwater energy transfer system 1 is configured to submerge the storage tank ST between a first position 100P in water and a second position 200P in water by the underwater navigation body 300. The storage tank ST may be a tank that is filled in a predetermined manner. The type of energy to be filled may be electrical energy, chemical energy, light energy, or the like. The mode of the energy to be filled may be appropriately adopted depending on the application and demand. Hereinafter, the energy-filled storage tank ST is referred to as a "filled tank STf". It should be noted that the fill rate of the filled tank STf may be a predetermined fill rate to be recovered. Also, prior to being energized, i.e. empty storage tank ST, hereinafter referred to as "empty tank STe." In FIG. 1, the filled tank STf is a shaded storage tank ST. Hereinafter, when the "filled tank STf" and the "empty tank STe" do not need to be distinguished from each other, the "storage tank ST" is referred to.

The storage tank ST may be filled with, for example, electric energy generated by the floating body 100 floating on the water in a predetermined manner. In the floating body 100, for example, power generation using renewable energy may be performed. Hereinafter, the floating body 100 in the present embodiment is referred to as a "power generation floating body 100". The first position 100P may be a position corresponding to the power generation floating body 100. For example, the first position 100P may be below the power generation floating body 100 that waits for recovery of the filled tank STf. The second position 200P may be a position corresponding to the transportation vessel 200 that serves as a collection destination for the filled tank STf. The second position 200P may be, for example, a position where the transportation vessel 200 can recover the filled tank STf. The transportation vessel 200 may be, for example, a vessel that transports the collected filled tank STf to a predetermined demand location.

The underwater navigation body 300 may include a tank attachment portion 310 to which the storage tank ST can be detachably attached. The underwater navigation body 300 is configured to be capable of underwater navigation with the storage tank ST attached to the tank attachment portion 310. For example, in the transportation vessel 200, the underwater navigation body 300 may mount an empty tank STe stored in the tank chamber TC of the transportation vessel 200 to the tank attachment portion 310. The empty tank STe may be carried by the underwater navigation body 300 from the second position 200P to the first position 100P. When the underwater navigation body 300 equipped with the empty tank STe arrives at the first position 100P, the underwater navigation body 300 may replace the empty tank STe and mount the filled tank STf to the tank attachment portion 310.

The empty tank STe released from the underwater navigation body 300 may be held in the power generation floating body 100 as a storage tank ST to charge electric energy instead of the filled tank STf. In this manner, in the underwater energy transfer system 1, the underwater navigation body 300 may replace the filled tank STf held by the power generation floating body 100 with an empty tank STe. The filled tank STf may be carried by the underwater navigation body 300 from the first position 100P to the second position 200P. When the underwater navigation body 300 equipped with the filled tank STf arrives at the second position 200P, for example, the filled tank STf may be released from the underwater navigation body 300 and stored in the tank chamber TC of the transportation vessel 200.

The operations described above with respect to the underwater navigation body 300 may be controlled by the navigation body control mechanism 400. The navigation body control mechanism 400 may include, for example, an attachment control unit 410 and a navigation control unit 420. The attachment control unit 410 may control the operation of the tank attachment portion 310 of the underwater navigation body 300. The navigation control unit 420 may control the underwater navigation of the underwater navigation body 300. Navigation body control mechanism 400 may be provided, for example, in power generation floating body 100, transportation vessel 200, or other facility. The navigation body control mechanism 400 may be distributed to, for example, the power generation floating body 100, the transportation vessel 200, and other facilities. The navigation body control mechanism 400 may be realized by so-called cloud computing. In the present embodiment, a case where the navigation body control mechanism 400 is provided in the underwater navigation body 300 will be described.

Configuration of the Power Generation Floating Body 100

First, the configuration of the power generation floating body 100 will be described with reference to FIG. 2. The power generation floating body 100 may be, for example, a sailing ship type floating body capable of navigating a river, a lake, a sea, or the like. The power generation floating body 100 according to the present embodiment will be described as a sailing ship type floating body that generates power using wind power at sea. In the present disclosure, the storage mode of the electric energy generated may be any mode. In this embodiment, an embodiment is described in which electrical energy is converted to hydrogen carriers and stored.

Figure 2:
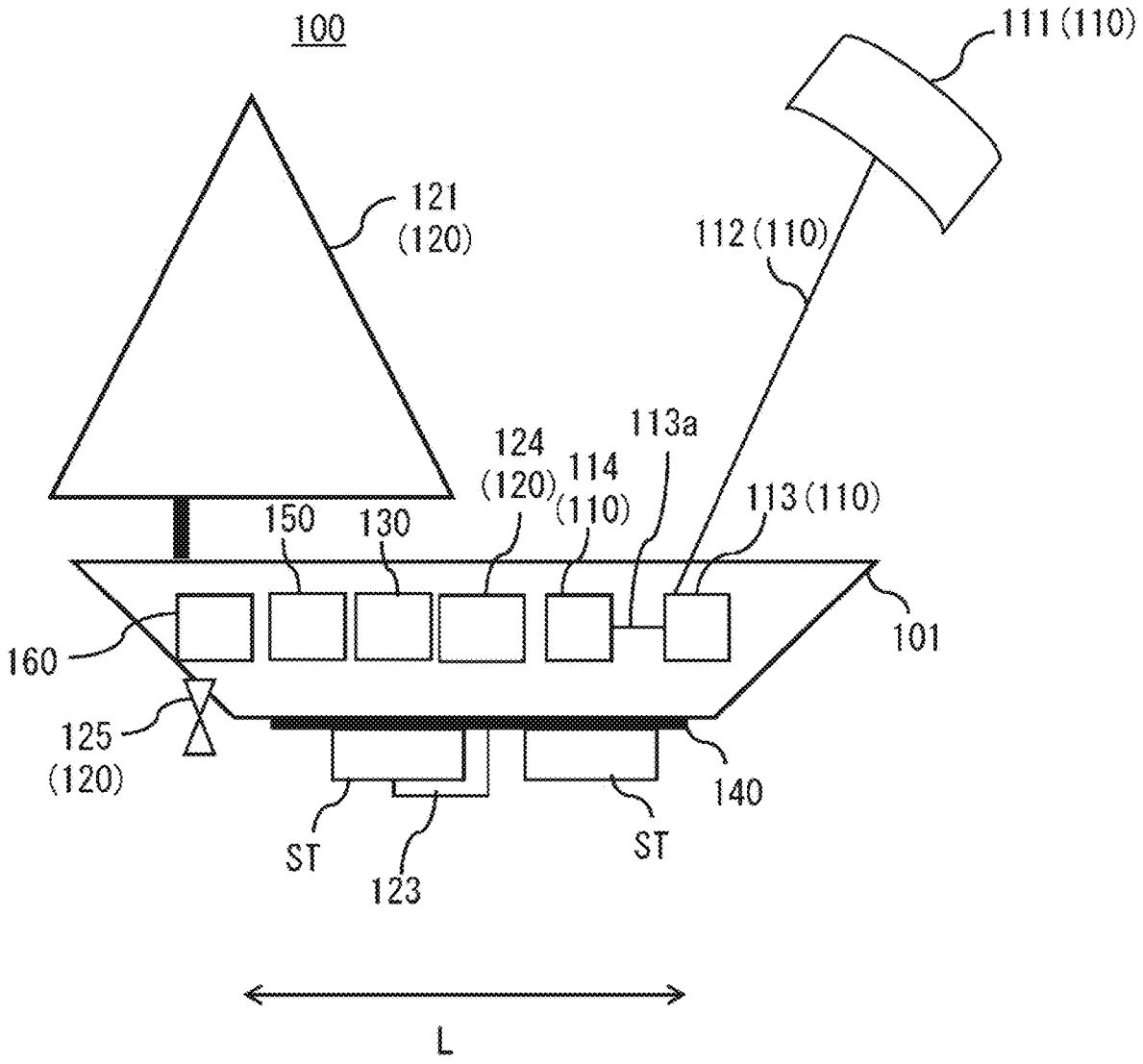
FIG. 2 is a schematic configuration diagram of an example of the power generation floating body shown in FIG. 1.

As an example, as shown in FIG. 2, the power generation floating body 100 includes a hull 101 floating on the water surface, and may further include, for example, a power generation unit 110, a navigation unit 120, a hydrogen carrier generation unit 130, a tank holding unit 140, a floating body communication unit 150, and a floating body control unit 160.

The power generation unit 110 may include a plurality of elements utilized for wind power generation. The power generation unit 110 may be configured to generate wind power using, for example, a kite 111 connected to the hull 101 via the tether 112. The power generation unit 110 may include a tether 112 and a kite 111, as well as a winch 113 and a generator 114, as shown in FIG. 2. The winch 113 has a rotating shaft body 113*a* as a rotating shaft, and the rotating shaft body 113*a* is connected to a rotating shaft of the generator 114. A tether 112 is wound around the rotating shaft body 113*a*. When the kite 111 is raised, the tether 112 is unwound from the winch 113 as the kite is raised. The rotating shaft body 113*a* is rotated by the feeding-out operation of the tether 112. The rotation shaft of the generator 114 rotates in conjunction with the rotation when the kite 111 moves upward, thereby generating electric power. Further, when the rotating shaft body 113*a* rotates in the winding direction of the tether 112, the tether 112 is collected and the kite 111 is lowered. When the tether 112 is collected, the generator 114 may rotate the rotating shaft body 113*a* based on a command from the floating body control unit 160.

The navigation unit 120 may include a plurality of elements for causing the power generation floating body 100 to navigate over the sea. The power generation floating body 100 may be configured to be capable of navigating (i.e., sailing) the sea using, for example, wind energy received in the sail 121 as a power source. In addition to the sail 121, the navigation unit 120 may be provided with, for example, a center board 123 that generates a lateral force, a ladder (not shown) that determines the direction of the hull 101, and the like. In addition, the power generation floating body 100 may include, for example, a thruster 125 and a motor 124 as a power source as the navigation unit 120 so as to be able to move by electric power in addition to moving by wind power. For example, electric power generated by the power generation unit 110 may be used to drive the motor 124. Further, the navigation unit 120 may include sensors necessary for maritime navigation. The sensors may include, for example, a wind direction wind speed sensor, a wind volume sensor, an acceleration sensor, an angular velocity sensor, a velocity sensor, and the like. For example, the navigation unit 120 may be controlled by control instructions from the floating body control unit 160 based on the route such that the power generation floating body 100 navigates a predetermined route.

The hydrogen carrier generation unit 130 may include a plurality of elements for converting electrical energy obtained by power generation of the power generation unit 110 into hydrogen carriers. As the hydrogen carrier, for example, hydrogen gas may be employed. The hydrogen carrier obtained by the hydrogen carrier generation unit 130 is not limited to hydrogen gas. The hydrogen carrier obtained by the hydrogen carrier generation unit 130 may be, for example, any of liquefied hydrogen, ammonia, methylcyclohexane, and the like.

The tank holding unit 140 may include a plurality of elements for holding the storage tank ST in water. The storage tank ST may be a hydrogen tank having a configuration suitable for storage of the employed hydrogen carrier. The storage tank ST in the present embodiment may be, for example, a hydrogen storage alloy tank having a hydrogen storage alloy. The tank holding unit 140 may be provided at the bottom of the hull 101 as shown in FIG. 2. The tank holding unit 140 may, for example, be configured such that at least two storage tank ST are held in one row in the vessel length direction L. FIG. 2 shows that the two storage tanks ST are held in one row in the vessel length direction L. In the present embodiment, a storage tank ST having a substantially rectangular parallelepiped is illustrated as an example, but the storage tank ST is not limited to a substantially rectangular parallelepiped. The storage tank ST may have any suitable configuration depending on the manner of energy stored.

The tank holding unit 140 may have, for example, hydrogen conduits so that hydrogen from the hydrogen carrier generation unit 130 is supplied to the held storage tank ST. In the tank holding unit 140, an appropriate method may be adopted as a method in which the storage tank ST is held, depending on the hydrogen tank adopted, such as an electromagnetic method or a physical method. The storage tank ST may be a battery tank having a battery in which electricity generated by the generator 114 is charged. In this case, the hydrogen carrier generation unit 130 may be omitted.

The floating body communication unit 150 may be configured to wirelessly communicate with other elements. The floating body communication unit 150 may be configured so that information transmitted from other elements to the power generation floating body 100 and information (including control instructions) transmitted from the power generation floating body 100 to other elements can be wirelessly communicated. The "other element" may include, for example, the transportation vessel 200, the underwater navigation body 300, and the like as appropriate. The floating body communication unit 150 may be configured to be capable of acquiring various types of positional information from a Global Navigation Satellite System (GNNS) device, a Global Positioning System (GPS) device, or the like in order to acquire the positional information of its own base.

The floating body control unit 160 may be configured as a control unit including, for example, a Central Processing Unit (CPU) and a storage device and an input/output interface required for the operation of CPU. The storage device may include, for example, Read Only Memory (ROM), Random Access Memory (RAM), and data storage. The floating body control unit 160 may be connected to each unit 110 to 150 by a data bus, for example, via an input/output interface. The floating body control unit 160 may output a control instruction to each of the units 110 to 150 to control various operations.

The storage device may hold various kinds of information necessary for each process performed by the power generation floating body 100. The storage device may hold, for example, a floating body ID for identifying the respective power generation floating bodies 100. For example, various types of information (including a control instruction) output from the power generation floating body 100 may include a floating body ID to indicate an output source.

ROM may store, for example, a computer program for implementing a process in the floating body control unit 160. The floating body control unit 160 may read a computer program stored in a ROM or data storage. Alternatively, the floating body control unit 160 may acquire (i.e., download) a computer program from a device (not shown) disposed outside the power generation floating body 100 via the floating body communication unit 150, and read the acquired computer program. The floating body control unit 160 executes the read computer program. As a result, a logical functional block for controlling the operation of the power generation floating body 100 is realized in the floating body control unit 160.

Composition of Transport Vessel

Figure 3:
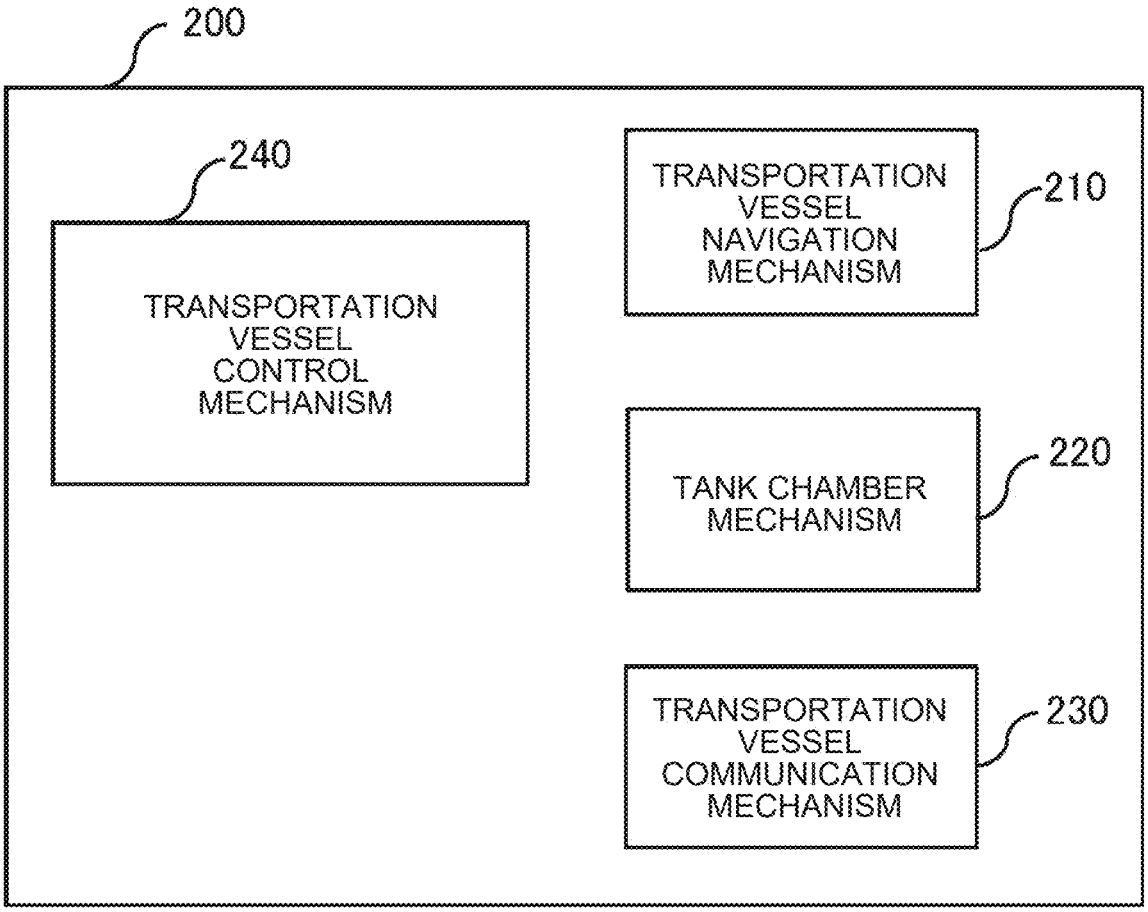
FIG. 3 is a schematic configuration diagram of an example of the transport vessel shown in FIG. 1.

The configuration of the transportation vessel 200 will be described with reference to FIG. 3. The transportation vessel 200 may include, for example, a transportation vessel navigation mechanism 210, a tank chamber mechanism 220, a transportation vessel communication mechanism 230, and a transportation vessel control mechanism 240. The transportation vessel 200 may further be provided with an operation mechanism (not shown) for receiving various operations of the seafarer.

The transportation vessel navigation mechanism 210 may include a plurality of elements for navigating the transportation vessel 200 at sea. The transportation vessel navigation mechanism 210 may include, for example, a steering mechanism including a steering device and the like, a propulsion mechanism including a thruster and the like, and a drive mechanism including an engine and the like. The tank chamber mechanism 220 may include a plurality of elements for storing the storage tank ST in a tank chamber TC. The tank chamber mechanism 220 may include, for example, a temperature sensor, a humidity sensor, a moving device such as a robot that moves the storage tank ST, and the like. The tank chamber TC may be provided in any of the inside and outside of the transportation vessel 200. The transportation vessel communication mechanism 230 may be configured to be capable of wirelessly communicating with other elements. The transportation vessel communication mechanism 230 may be configured to allow wireless communication of information transmitted from other elements to the transportation vessel 200 and information (including control instructions) transmitted from the transportation vessel 200 to other elements. The "other element" may include, for example, the power generation floating body 100, the underwater navigation body 300, and the like as appropriate.

The transportation vessel control mechanism 240 may be configured as a control unit including, for example, a Central Processing Unit (CPU) and a storage device and an input/output interface required for the operation of CPU. The storage device may include, for example, Read Only Memory (ROM), Random Access Memory (RAM), and data storage. The transportation vessel control mechanism 240 may be connected to each mechanism 210-230 by a data bus, for example, via an input/output interface. The transportation vessel control mechanism 240 may output control instructions to the respective mechanisms 210-230 to control various operations.

The storage device may hold various kinds of information necessary for each process performed by the transportation vessel 200. ROM may store, for example, a computer program for implementing a process in the transportation vessel 200. The transportation vessel control mechanism 240 may read a computer program stored in a ROM or data storage. Alternatively, the transportation vessel control mechanism 240 may acquire (i.e., download) a computer program from a device (not shown) disposed outside the transportation vessel 200 via the transportation vessel communication mechanism 230, and read the acquired computer program. The transportation vessel control mechanism 240 executes the read computer program. As a result, a logical functional block for controlling the operation of the transportation vessel 200 is realized in the transportation vessel control mechanism 240.

Structure of the Underwater Navigation Body

Figure 4A:
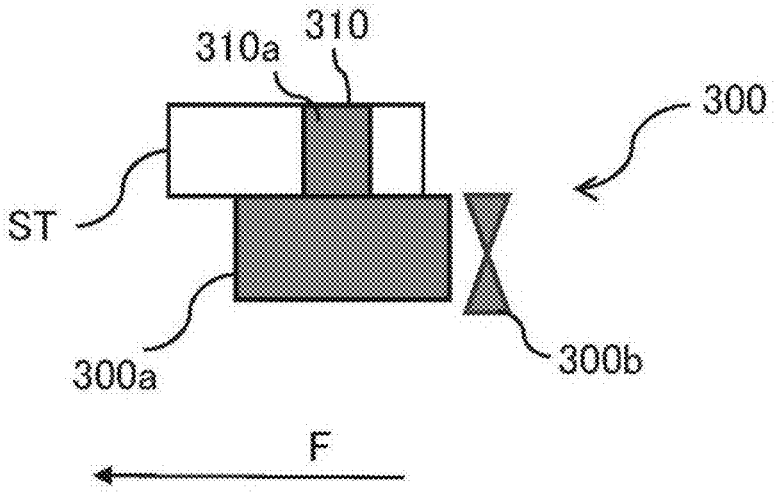
FIG. 4A illustrates an embodiment of the configuration of an underwater navigation body shown in FIG. 1.
Figure 4B:
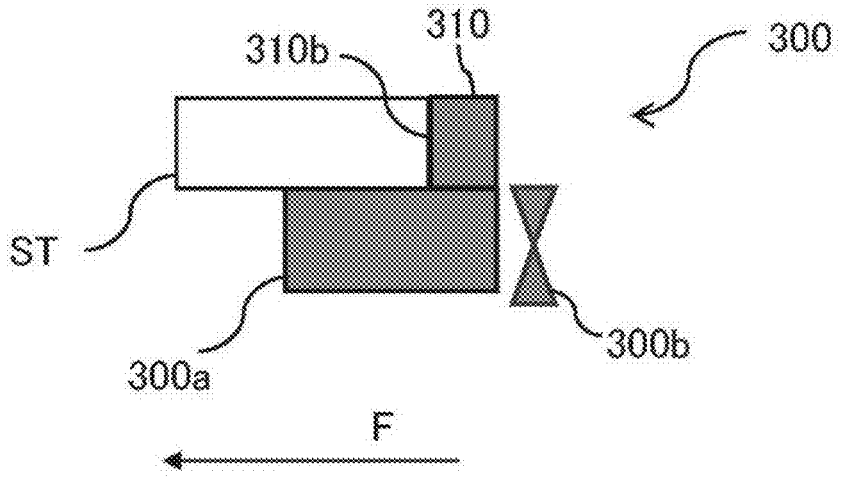
FIG. 4B illustrates another embodiment of the configuration of an underwater navigation body shown in FIG. 1.

The configuration of the underwater navigation body 300 will be described with reference to FIG. 4A, FIG. 4B, and FIG. 5. First, exemplary shapes of the underwater navigation body 300 will be described with reference to FIG. 4A and FIG. 4B. FIGS. 4A and 4B show the sides of the underwater navigation body 300 with the storage tank ST attached to the tank attachment portion 310. The underwater navigation body 300 may include, for example, a body 300*a* and a thruster 300*b* as a propeller in addition to the tank attachment portion 310 described above. The underwater navigation body 300 may be configured to advance in the F-direction by thruster 300*b* propulsion.

The tank attachment portion 310 may be configured as appropriate in accordance with the configuration of the storage tank ST so that the storage tank ST can be detachably attached. For example, as shown in FIG. 4A, the tank attachment portion 310 may be a belt type having a belt 310*a* that can be wrapped around the storage tank ST. By tightening and loosening the belt 310*a*, the storage tank ST may be attached to and detached from the tank attachment portion 310. For example, as shown in FIG. 4B, the tank attachment portion 310 may be a rear end mounting type having a mounting surface 310*b* capable of detachably mounting the rear end surface of the storage tank ST. As a mounting method in the mounting surface 310*b*, any mounting method such as electromagnetically mounting or physically mounting may be employed. Further, the tank attachment portion 310 may be, for example, a holding type having an arm capable of holding the storage tank ST. In FIG. 4A and FIG. 4B, the storage tank ST is mounted on the upper portion of the body 300*a*, but the tank attachment portion 310 may be provided so that the storage tank ST is mounted on the lower portion of the body 300*a*.

Figure 5:
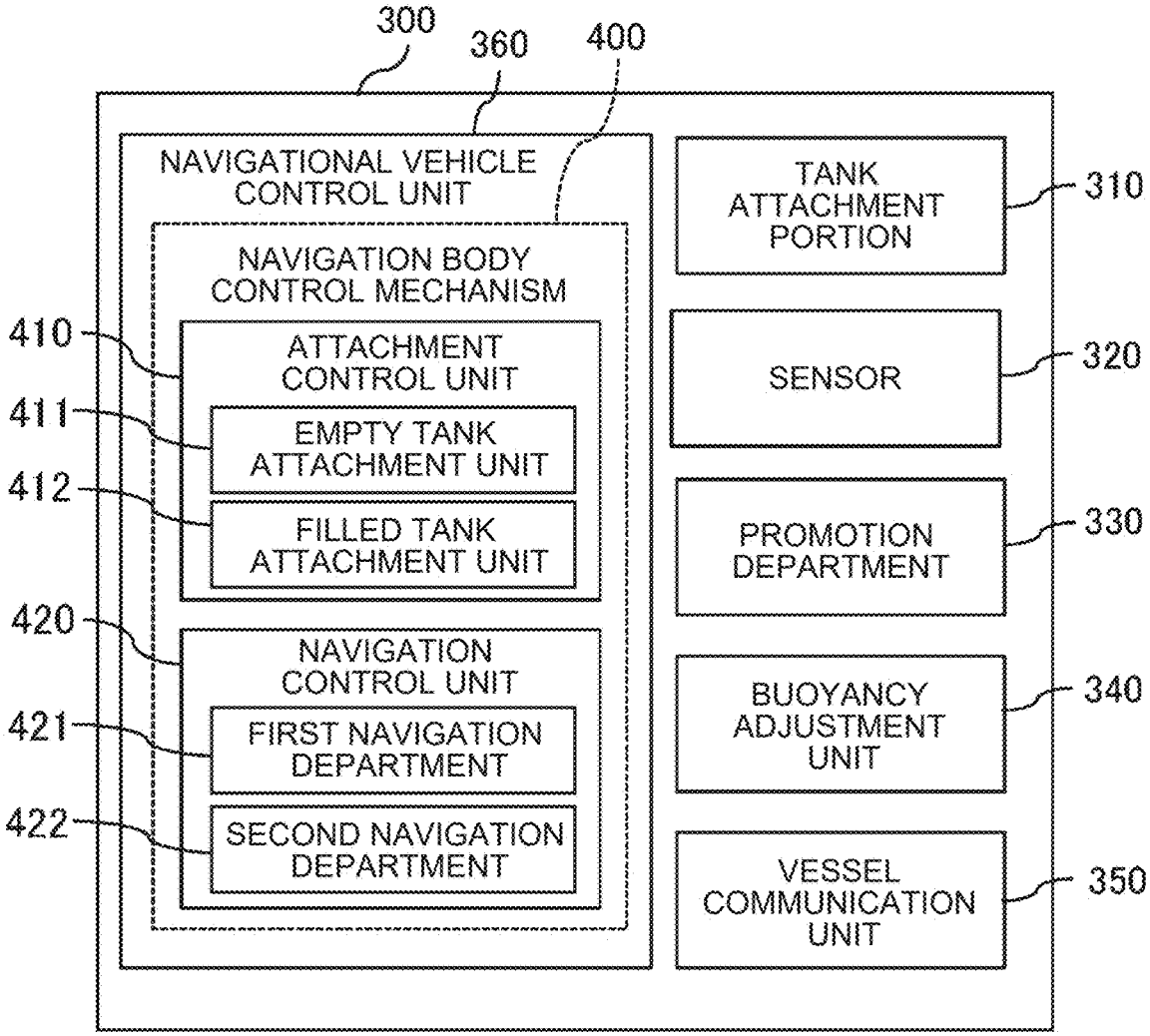
FIG. 5 is a schematic configuration diagram of an example of an underwater navigation body shown in FIG. 1.

As illustrated in FIG. 5, the underwater navigation body 300 may include, for example, a sensor unit 320, a propulsion unit 330, a buoyancy adjustment unit 340, a navigation body communication unit 350, and a navigation body control unit 360 in addition to the tank attachment portion 310 described above.

The sensor unit 320 may include, for example, sensors necessary for autonomous navigation in water. The sensor unit 320 may include, for example, various sonars, cameras, and the like. The sensor unit 320 may include necessary sensors depending on the autonomous navigation employed in the underwater navigation body 300. The autonomous navigation employed in the underwater navigation body 300 is not particularly limited. The sensor unit 320 may include, for example, an inertial navigation device, a Doppler velocimeter, or the like required for inertial navigation. The sensor unit 320 may further include sensors for monitoring the state of the user. Sensors for monitoring the state of the vehicle may include, for example, sensors for detecting temperature, pressure, water leakage, voltage, and the like in the underwater navigation body 300.

The propulsion unit 330 may include a plurality of elements necessary to propel the underwater navigation body 300 in water. The propulsion unit 330 may include, for example, a motor and a battery as a power source in addition to the thruster 300*b* described above. In addition to or in place of the battery, for example, a fuel cell may be employed. When a fuel cell is employed, for example, hydrogen may be supplied from a storage tank ST mounted on the tank attachment portion 310. The buoyancy adjustment unit 340 may include a plurality of elements necessary to adjust the buoyancy of the underwater navigation body 300. The buoyancy adjustment unit 340 may include, for example, an air chamber having a variable volume. For example, the buoyancy adjustment unit 340 may be configured to adjust the buoyancy of the underwater navigation body 300 by changing the volume of the air chamber under the control of the navigation body control unit 360.

The navigation body communication unit 350 may be configured to be capable of underwater wireless communication (e.g., underwater acoustic communication) with other elements. The navigation body communication unit 350 may be configured to enable wireless communication of information transmitted from other elements to the underwater navigation body 300 and information (including control instructions) transmitted from the underwater navigation body 300 to other elements. The "other element" may include, for example, the power generation floating body 100, the transportation vessel 200, and the like as appropriate.

The navigation body control unit 360 may be configured as a control unit including, for example, a Central Processing Unit (CPU) and a storage device, an input/output interface, and the like required for the operation of CPU. The storage device may include, for example, Read Only Memory (ROM), Random Access Memory (RAM), and data storage. The navigation body control unit 360 may be connected to the respective portions 310 to 350 via a data bus, for example, via an input/output interface. The navigation body control unit 360 may control various operations by outputting control instructions to the respective portions 310 to 350.

The storage device may hold various kinds of information necessary for each process performed by the underwater navigation body 300. ROM may store, for example, a computer program for implementing a process in the navigation body control unit 360. The navigation body control unit 360 may read a computer program stored in a ROM or data storage. Alternatively, the navigation body control unit 360 may acquire (i.e., download) a computer program from a device (not shown) disposed outside the underwater navigation body 300 via the navigation body communication unit 350, and read the acquired computer program. The navigation body control unit 360 executes the read computer program. As a result, a logical functional block for controlling the operation of the underwater navigation body 300 is realized in the navigation body control unit 360.

FIG. 5 illustrates, as an example of a functional block, a state in which the navigation body control mechanism 400 is realized in the navigation body control unit 360. As described above, the navigation body control mechanism 400 may include the attachment control unit 410 and the navigation control unit 420. The attachment control unit 410 may control the attachment and detachment of the storage tank ST to and from the tank attachment portion 310. That is, the attachment control unit 410 may control the operation of the tank attachment portion 310 so that the storage tank ST is mounted to the tank attachment portion 310. In addition, the attachment control unit 410 may control the operation of the tank attachment portion 310 so that the storage tank ST is released from the tank attachment portion 310.

The attachment control unit 410 may include, for example, an empty tank attachment unit 411 and a filled tank attachment unit 412. The empty tank attachment unit 411 may perform, for example, control related to mounting of the empty tank STe. For example, the filled tank attachment unit 412 may perform control for releasing the empty tank STe from the tank attachment portion 310 and mounting the filled tank STf to the tank attachment portion 310 instead of the empty tank STe. The attachment control unit 410 may, for example, control the tank attachment portion 310 without assistance from other elements (e.g., the power generation floating body 100 and/or the transportation vessel 200). Alternatively, the attachment control unit 410 may control the tank attachment portion 310 while receiving support from other elements as appropriate, for example.

The navigation control unit 420 may control underwater navigation (i.e., underwater movement) of the underwater navigation body 300. The navigation control unit 420 may include, for example, a first navigation unit 421 and a second navigation unit 422. For example, the first navigation unit 421 may perform control for causing the underwater navigation body 300 equipped with the empty tank STe to underwater navigation in the first position 100P. For example, the second navigation unit 422 may perform control for causing the underwater navigation body 300 equipped with the filled tank STf to underwater-navigate to the second position 200P. The navigation control unit 420 may, for example, cause the underwater navigation body 300 to autonomously navigate without assistance from other elements (e.g., the power generation floating body 100 and/or the transportation vessel 200). Alternatively, the navigation control unit 420 may cause the underwater navigation body 300 to navigate, for example, while receiving assistance from other elements as appropriate.

Figure 6:
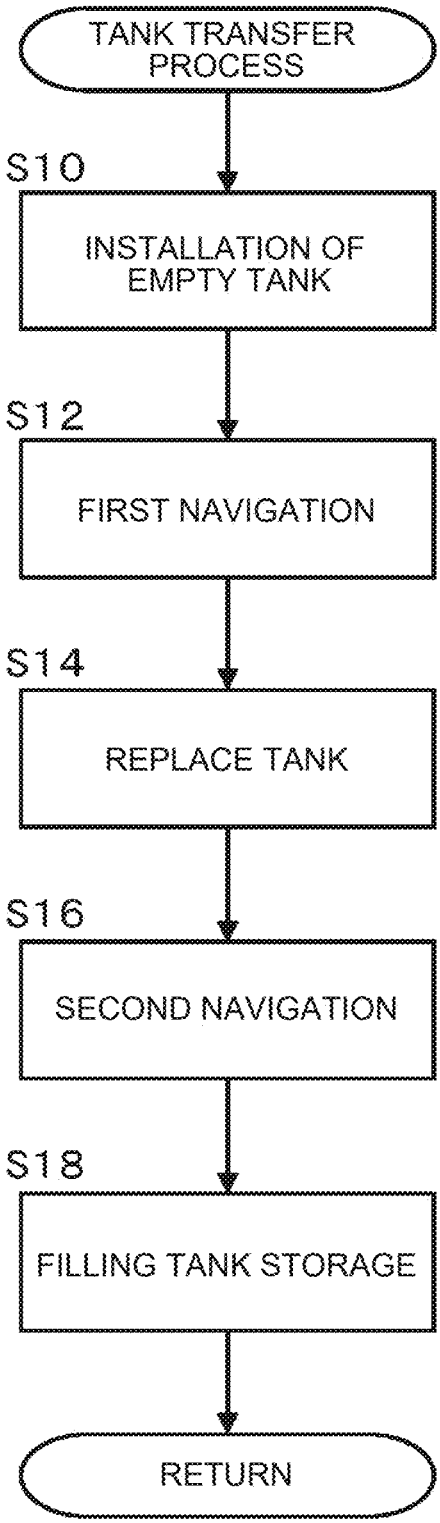
FIG. 6 is a flowchart illustrating an example of a tank transfer process.

In the underwater energy transfer system 1, as described above, the underwater navigation body 300 may replace the storage tank ST held by the power generation floating body 100. The tank transfer process performed in the underwater energy transfer system 1 for this exchange is described with reference to FIG. 6. The processing by the power generation floating body 100 may be performed by the floating body control unit 160. The processing by the transportation vessel 200 may be performed by the transportation vessel control mechanism 240. Processing by the underwater navigation body 300 may be performed by the navigation body control mechanism 400 (in the present embodiment, the navigation body control unit 360). Hereinafter, the tank transfer process will be mainly described with respect to the process performed by the navigation body control mechanism 400 provided in the underwater navigation body 300.

In the underwater energy transfer system 1, an empty tank-mounting process may first be performed (S10). The empty tank mounting process may be performed, for example, at predetermined time intervals. The empty tank mounting process may be performed, for example, when a tank exchange signal transmitted from the power generation floating body 100 is received by the transportation vessel 200. In the empty tank mounting process, for example, the empty tank STe held in the tank chamber TC may be mounted on the tank attachment portion 310. For example, a moving device such as a robotic machine controlled by the transportation vessel control mechanism 240 may place an empty tank STe in the tank chamber TC at a predetermined position outside the tank chamber TC. The empty tank attachment unit 411 may control the tank attachment portion 310 alone or in cooperation with the moving device so that the empty tank STe disposed at the predetermined position is mounted on the tank attachment portion 310.

Once the empty tank STe is attached to the underwater navigation body 300, a first navigation process may be performed (S12). In the first navigation process, for example, the first navigation unit 421 may cause the underwater navigation body 300 to autonomously navigate toward the first position 100P. The first navigation unit 421 may estimate its current position and traveling direction based on, for example, an inertial navigation device and a Doppler anemometer. For example, when at least one landmark (a transponder, an acoustic lighthouse, or the like) is provided in the water or the seabed, the first navigation unit 421 may estimate its current position and traveling direction based on the distance from the landmark. Autonomous navigation by the first navigation unit 421 may be performed with assistance from other elements (e.g., the power generation floating body 100 and/or the transportation vessel 200). Alternatively, autonomous navigation by the first navigation unit 421 may be performed without assistance from other elements.

Figure 7:
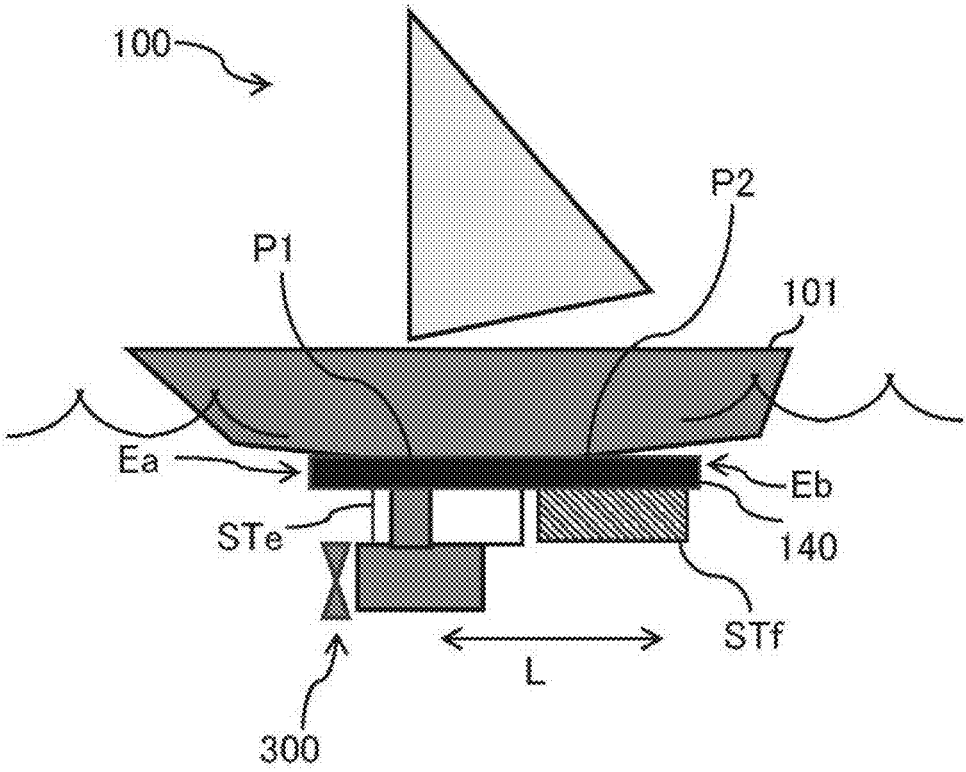
FIG. 7 is an explanatory view for explaining a tank replacement process in the tank transfer process.

When the underwater navigation body 300 arrives at the first position 100P, a tank-replacement process may be performed (S14). In the tank replacing process, the storage tank ST held by the power generation floating body 100 may be replaced from the filled tank STf to the empty tank STe. A specific example of the tank replacement process will be described with reference to FIG. 7. As described above, the tank holding unit 140 of the power generation floating body 100 may extend in the vessel length direction L and be provided at the bottom of the hull 101. Hereinafter, with respect to the vessel length direction L, one end side of the tank holding unit 140 is referred to as an "end Ea", and the other end side is referred to as an "end Eb". In the embodiment shown in FIG. 7, the filled tank STf is held Eb the end of the tank holding unit 140.

The movement of the underwater navigation body 300 in the tank replacement process may be controlled by the navigation control unit 420. The navigation control unit 420 may move the underwater navigation body 300 while receiving support from the outside such as the power generation floating body 100. Alternatively, the navigation control unit 420 may independently move the underwater navigation body 300 based on the sonar information, the image information by the camera, and the like. The underwater navigation body 300 equipped with the empty tank STe may, for example, move from the end Eb opposite the end Ea toward the vessel length direction L and move to the release position P1 of the empty tank STe. The underwater navigation body 300 on which the empty tank STe is mounted may float, for example, from below the tank holding unit 140 so as to be located in the release position P1.

When the underwater navigation body 300 reaches the release position P1, the filled tank attachment unit 412 may control the tank attachment portion 310 to release the empty tank STe from the tank attachment portion 310. After release of the empty tank STe, the underwater navigation body 300 may travel toward the vessel length direction L to the mounting position P2 of the filled tank STf. That is, when the empty tank STe is released from the tank attachment portion 310, the underwater navigation body 300 may move to the filled tank STf. For example, the underwater navigation body 300 may move to a mounting position P2 where the filled tank STf is mounted. When the underwater navigation body 300 reaches the mounting position P2, the filled tank attachment unit 412 may control the tank attachment portion 310 to mount the filled tank STf to the tank attachment portion 310. The tank holding unit 140 may be provided with, for example, at least one rail extending in the vessel length direction L. The underwater navigation body 300 may then be guided to the track to move to the release position P1 and to the mounting position P2.

Referring back to FIG. 6, a process performed after the tank replacement process will be described. Once the filled tank STf is attached to the underwater navigation body 300, a second navigation process may be S16. In the second navigation process, for example, the second navigation unit 422 may cause the underwater navigation body 300 to autonomously navigate from the power generation floating body 100 toward the second position 200P to which the filled tank STf is attached. The mode of navigation in the second navigation process may be the same as the mode of navigation in the first navigation process (S12). When the underwater navigation body 300 equipped with the filled tank STf arrives at the second position 200P, a filling tank storage process may be performed (S18).

In the filling tank storage process, for example, the attachment control unit 410 may control the tank attachment portion 310 to release the filled tank STf from the tank attachment portion 310. Release of the filled tank STf may be performed, for example, in a second position 200P. Alternatively, the release of the filled tank STf may be performed at a predetermined position by moving the underwater navigation body 300 further to the predetermined position. Subsequently, for example, the transportation vessel control mechanism 240 may control the above-described moving device to store the filled tank STf released from the underwater navigation body 300 in the tank chamber TC. In the filling tank storage process, for example, the attachment control unit 410 and the transportation vessel control mechanism 240 may cooperate to transfer the released filled tank STf to the moving device.

Thus, the tank transfer process may be ended. According to the tank transfer process, the filled tank STf held by the power generation floating body 100 is collected by the transportation vessel 200, and the storage tank ST held by the power generation floating body 100 is replaced from the filled tank STf to the empty tank STe. The power generation floating body 100 allows for the storage of electric energy (in this embodiment, hydrogen) in a new empty tank STe.

2. Second Embodiment

In the underwater energy transfer system 1 according to the present disclosure, an underwater navigation body 300 having a configuration different from the above-described configuration and a power generation floating body 100 different from the above-described configuration may be employed. An underwater navigation body 300 having a configuration different from that of the first embodiment and a power generation floating body 100 having a configuration different from that of the first embodiment will be described as a second embodiment. Hereinafter, portions different from those of the first embodiment will be described, and portions that may be the same as those of the first embodiment will be omitted as appropriate. In the following description, the same reference numerals as in the first embodiment are applied to configurations corresponding to the first embodiment.

Figure 8A:
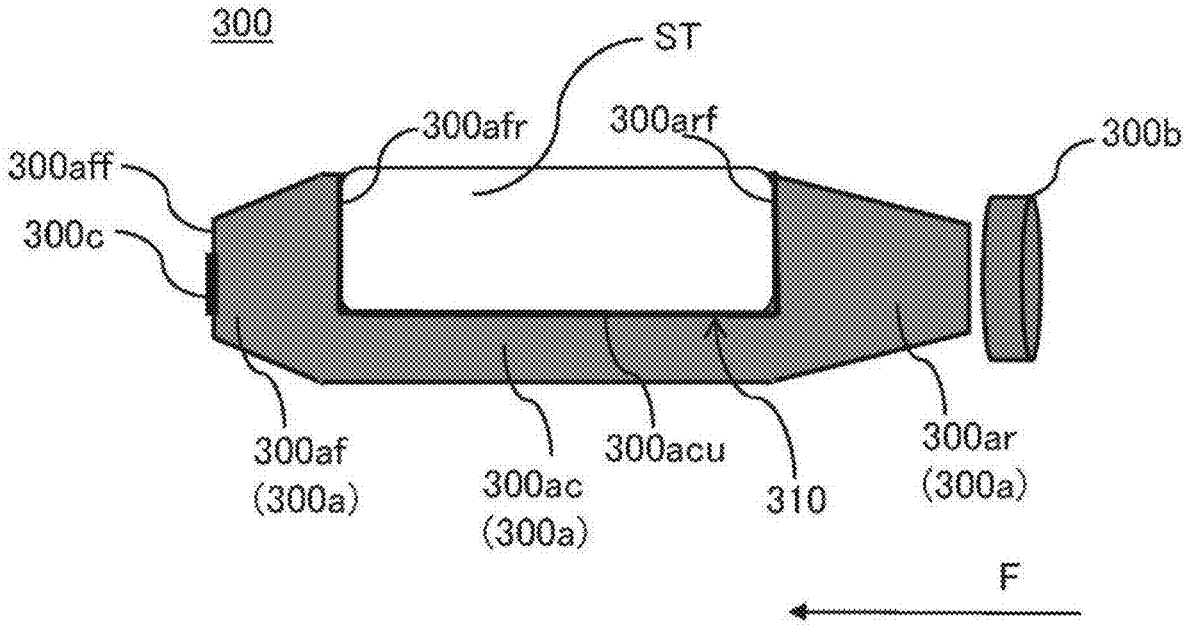
FIG. 8A is a side view of an underwater navigation body according to a second embodiment.
Figure 8B:
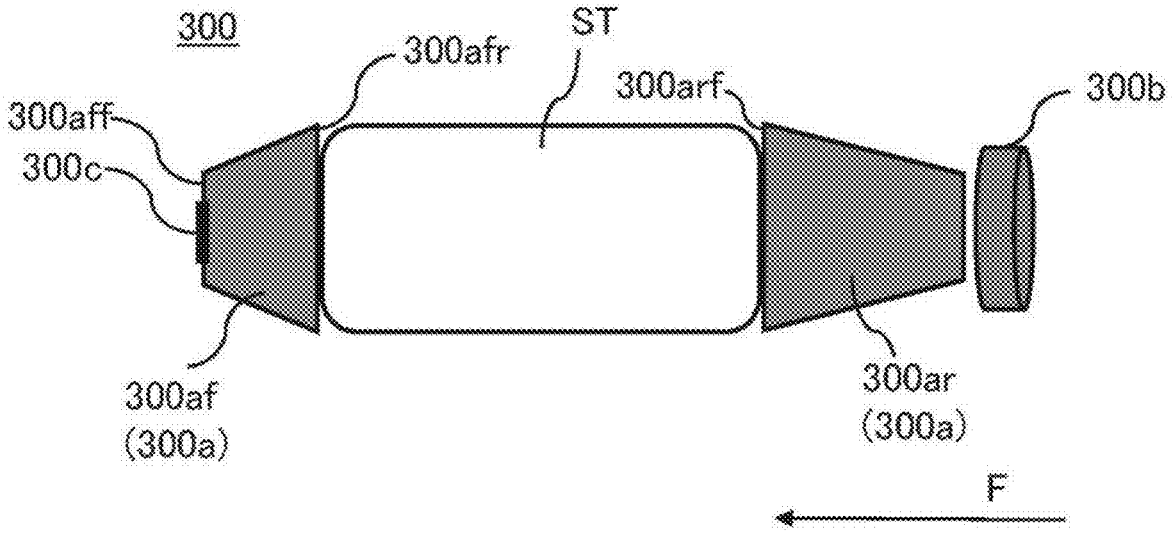
FIG. 8B is a top view of an underwater navigation body according to a second embodiment.

The underwater navigation body 300 according to the second embodiment will be described with reference to FIG. 8A and FIG. 8B. FIG. 8A is a side view of an underwater navigation body 300 according to a second embodiment of the present. In FIG. 8B, an upper surface of an underwater navigation body 300 according to a second embodiment is shown. As shown in FIG. 8A and FIG. 8B, the underwater navigation body 300 may have a torpedo configuration and be configured to be advanced in the F-direction by a thruster 300*b*.

The body 300*a* of the underwater navigation body 300 may be composed of three parts, namely, a front body 300*af*, a center body 300*ac*, and a rear body 300*ar*, in the front-rear direction. The tank attachment portion 310 may be provided on the center body 300*ac*, for example. For example, the tank attachment portion 310 may be configured such that the storage tank ST is fitted into the three surfaces of the rear surface 300*afr* of the front body 300*af*, the front surface 300*arf* of the rear body 300*ar*, and the upper surface 300*acu* of the center body 300*ac*. As a method of attaching the tank attachment portion 310 to the three surfaces, any attachment method such as electromagnetic attachment or physical attachment may be adopted, for example. Note that, in FIG. 8A and FIG. 8B, the storage tank ST is mounted on the upper portion of the center body 300*ac*, but the tank attachment portion 310 may be configured such that the storage tank ST is mounted on the lower portion of the center body 300*ac*. The front body 300*af* may be provided with, for example, a sensor unit 320, a buoyancy adjustment unit 340, and the like.

On the front surface 300*aff* of the front body 300*af*, that is, on the front surface of the underwater navigation body 300, a docking portion 300*c* connected to a pull-up joint 171 to be described later may be provided. The docking portion 300*c* may be provided with a configuration corresponding to the connecting mode. The docking portion 300*c* may be provided with, for example, a self-opening/closing hook for physical connection. Alternatively, the docking portion 300*c* may be provided with, for example, magnet mechanisms for electromagnetically connecting. For example, the connecting status of the docking portion 300*c* may be switched under the control of the navigation body control unit 360. For example, when the automatic opening/closing hook is provided in the docking portion 300*c*, the opening/closing of the automatic opening/closing hook may be controlled by the navigation body control unit 360. For example, when the magnet mechanism is provided in the docking portion 300*c*, the magnetic force generation in the magnet mechanism may be controlled by the navigation body control unit 360.

The rear body 300*ar* may be provided with, for example, a power unit (for example, a motor, a battery, and the like) of the propulsion unit 330, a buoyancy adjustment unit 340, a navigation body communication unit 350, and the like. The power unit may be a fuel cell in addition to or instead of a battery. When a fuel cell is employed, for example, hydrogen may be supplied from a storage tank ST mounted on the tank attachment portion 310. The navigation body control unit 360 may be provided in any of the front body 300*af*, the center body 300*ac*, and the rear body 300*ar*. The navigation body control unit 360 may be provided so as to be distributed at three locations, for example, the front body 300*af*, the center body 300*ac*, and the rear body 300*ar*. For example, the navigation body control unit 360 may be configured such that each control unit corresponding to the control target is appropriately arranged according to the control target.

Figure 9:
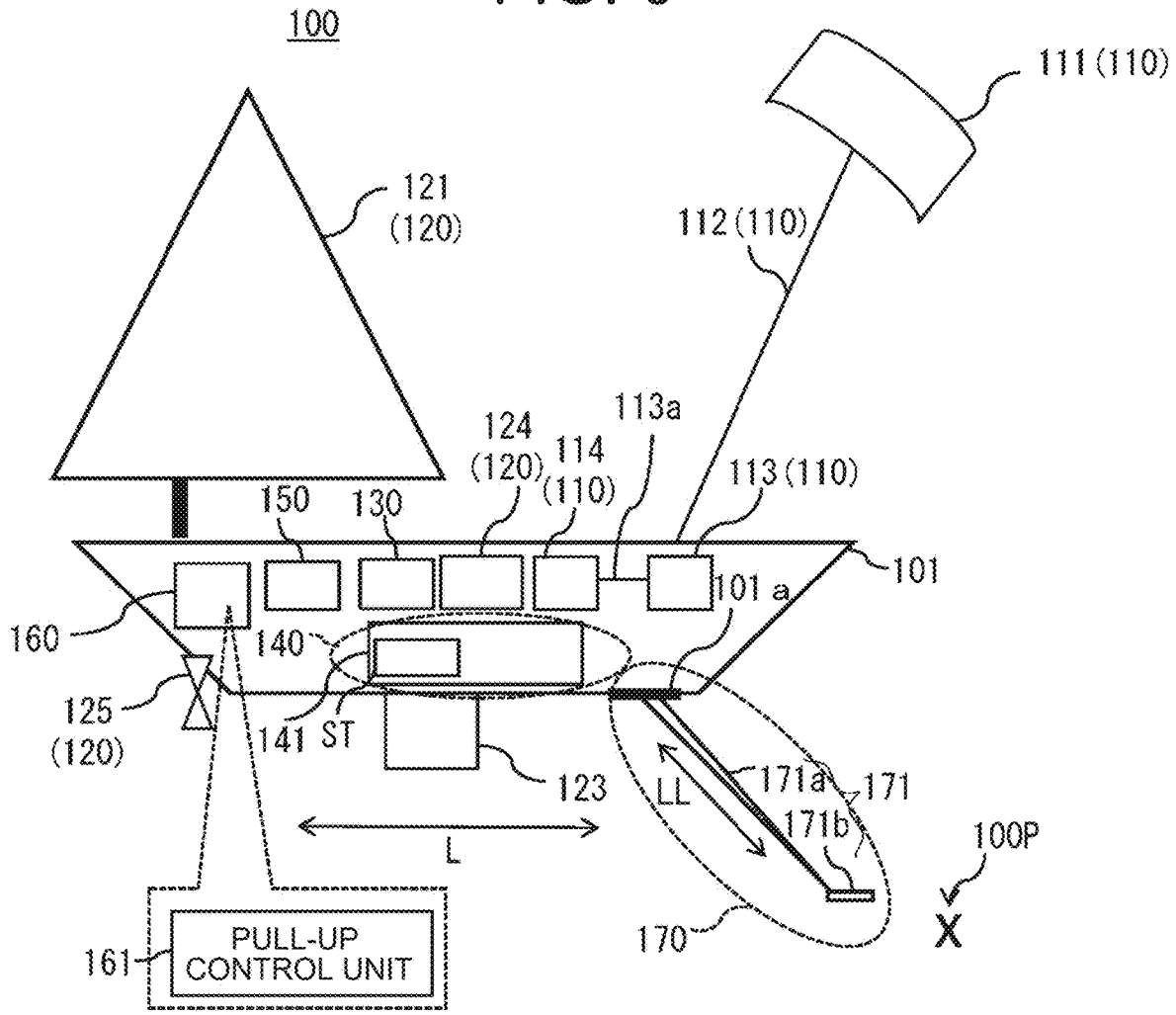
FIG. 9 is a schematic configuration diagram of an example of a power generation floating body according to a second embodiment.

As shown in FIG. 9, the power generation floating body 100 according to the second embodiment includes a pull-up unit 170 in addition to the configuration according to the first embodiment. The pull-up unit 170 may have a plurality of elements for pull-up the underwater navigation body 300 in the sea to the power generation floating body 100. The pull-up unit 170 may have a pull-up joint 171, shown in FIG. 9 as an example. The pull-up joints 171 may include, for example, a flexible arm 171*a* extending from the bottom of the power generation floating body 100 into the sea, and a navigation body connection portion 171*b* provided at the distal end of the flexible arm 171*a*. The flexible arm 171*a* may extend downward, for example, from a pull-up port 101*a* provided at the bottom of the hull 101. The pull-up port 101*a* may function as an entrance to the power generation floating body 100 of the underwater navigation body 300.

The flexible arm 171*a* may be provided to be extendable and retractable in the longitudinal LL under the control of the pull-up control unit 161, which will be described later, for example. The flexible arm 171*a* may be resilient so as to swing in response to waves or ocean currents in the sea. The navigation body connection portion 171*b* may be configured to be connectable to a docking portion 300*c* of the underwater navigation body 300. The navigation body connection portion 171*b* may be configured to be capable of connection according to a connection mode employed in the docking portion 300*c*. The navigation body connection portion 171*b* may be provided with, for example, an eyebolt connectable to the self-opening/closing hook of the docking portion 300*c*. The navigation body connection portion 171*b* may be provided, for example, with a magnetically connectable metallic portion to the magnet mechanisms of the docking portion 300*c*.

The first position 100P in the second embodiment may be, for example, a position in the vicinity of the navigation body connection portion 171*b* as a position corresponding to the power generation floating body 100. Further, the pull-up unit 170 may include a mobile device, such as a robotic device that moves the storage tank ST.

The tank holding unit 140 according to the second embodiment may include, for example, a tank holding portion 141 provided in the power generation floating body 100. The tank holding portion 141 may hold, for example, a storage tank ST to which hydrogen is supplied from the hydrogen carrier generation unit 130. The tank holding portion 141 may hold, for example, the filled tank STf that has reached the filling rate to be collected. The tank holding portion 141 may be provided with an entrance into and out of which the storage tank ST is taken in and out. Further, the tank holding unit 140 may include, for example, a moving device such as a robot that moves the storage tank ST.

In the floating body control unit 160, for example, the pull-up control unit 161 may be realized as a functional block. The pull-up control unit 161 may control the operation of each element in the pull-up unit 170. For example, the pull-up control unit 161 may control an operation in which the flexible arm 171*a* expands and contracts in the longitudinal LL. Other configurations of the power generation floating body 100 may be the same as those of the first embodiment.

In the tank transfer process (FIG. 6) according to the second embodiment, similarly to the first embodiment, the storage tank ST held in the power generation floating body 100 may be replaced from the filled tank STf to the empty tank STe. In the tank transfer process of the second embodiment, the same process as that of the first embodiment may be performed except for the tank replacement process (S14). The tank-replacing process according to the second embodiment will be described with reference to FIG. 10A to FIG. 11B. In the tank-replacing process, as shown in FIG. 10A to FIG. 11B, the floating body control unit 160 of the power generation floating body 100 may control the navigation unit 120 so as to move the power generation floating body 100 in the directional FF for ensuring the stability.

The tank replacement process may be performed when the underwater navigation body 300 equipped with the empty tank STe arrives at the first position 100P. The pull-up control unit 161 of the power generation floating body 100 may cause the pull-up joints 171 to extend downward from the pull-up port 101*a* to wait for the underwater navigation body 300 to arrive at the first position 100P. Alternatively, after the underwater navigation body 300 arrives at the first position 100P, the pull-up control unit 161 may extend the pull-up joint 171 downward from the pull-up port 101*a*. For example, the pull-up control unit 161 may recognize that the underwater navigation body 300 has arrived at the first position 100P on the basis of the sensor information provided in the power generation floating body 100 and the image information of the camera. Alternatively, based on the arrival notification transmitted from the underwater navigation body 300, the pull-up control unit 161 may recognize that the underwater navigation body 300 has arrived at the first position 100P.

Figure 10A:
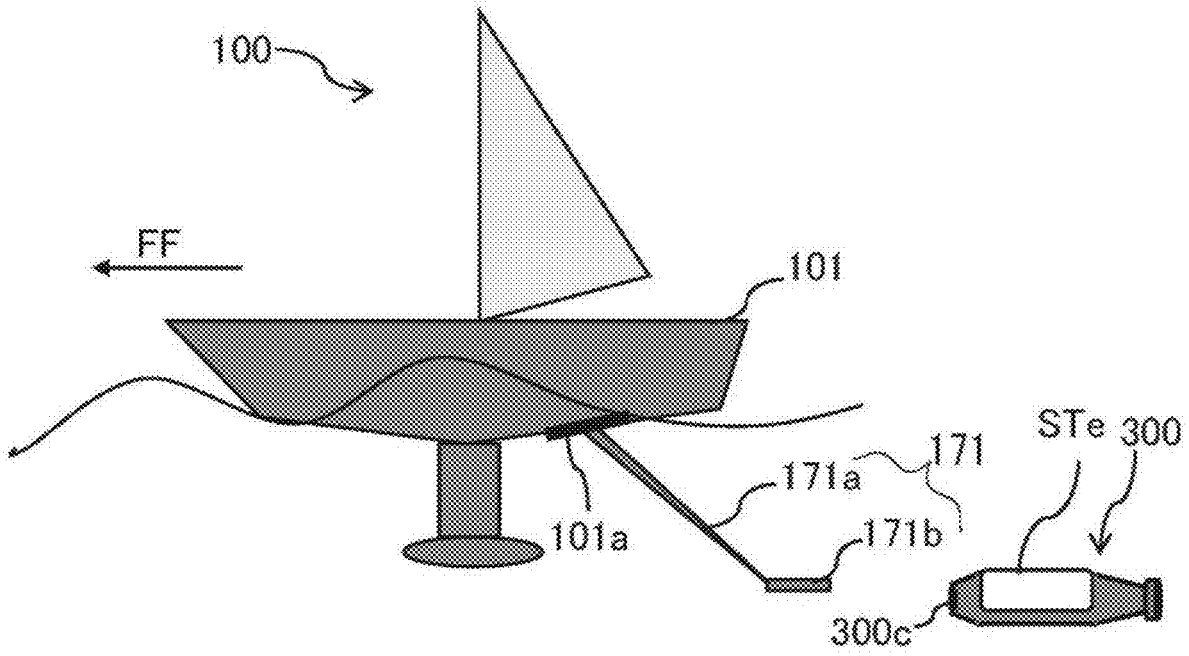
FIG. 10A shows an underwater navigation body approaching the drawer joints.

When the underwater navigation body 300 with the empty tank STe mounted thereon arrives at the first position 100P, the underwater navigation body 300 may first approach the pull-up joint 171 such that the docking portion 300*c* is connected to the navigation body connection portion 171*b*, as shown in FIG. 10A. That is, the navigation control unit 420 may cause the underwater navigation body 300 to approach the pull-up joint 171 so that the docking portion 300*c* of the underwater navigation body 300 is connected to the navigation body connection portion 171*b*. The navigation control unit 420 may recognize the position of the navigation body connection portion 171*b* based on, for example, camera-based image information and/or sonar information.

Alternatively, the navigation control unit 420 may bring the underwater navigation body 300 close to the pull-up joint 171 in response to the support from the power generation floating body 100. For example, the navigation body connection portion 171*b* may be provided with a transmitter that emits sound waves at a predetermined frequency. The pull-up control unit 161 of the power generation floating body 100 may transmit the sound wave from the transmitter of the navigation body connection portion 171*b*. The navigation control unit 420 may cause the docking portion 300*c* to approach the navigation body connection portion 171*b* based on the sound wave. It should be noted that if the sound wave is transmitted from the navigation body connection portion 171*b*, the area (i.e., zone) to which the sound wave reaches in the underwater energy transfer system 1 may be determined as the first position 100P.

Figure 10B:
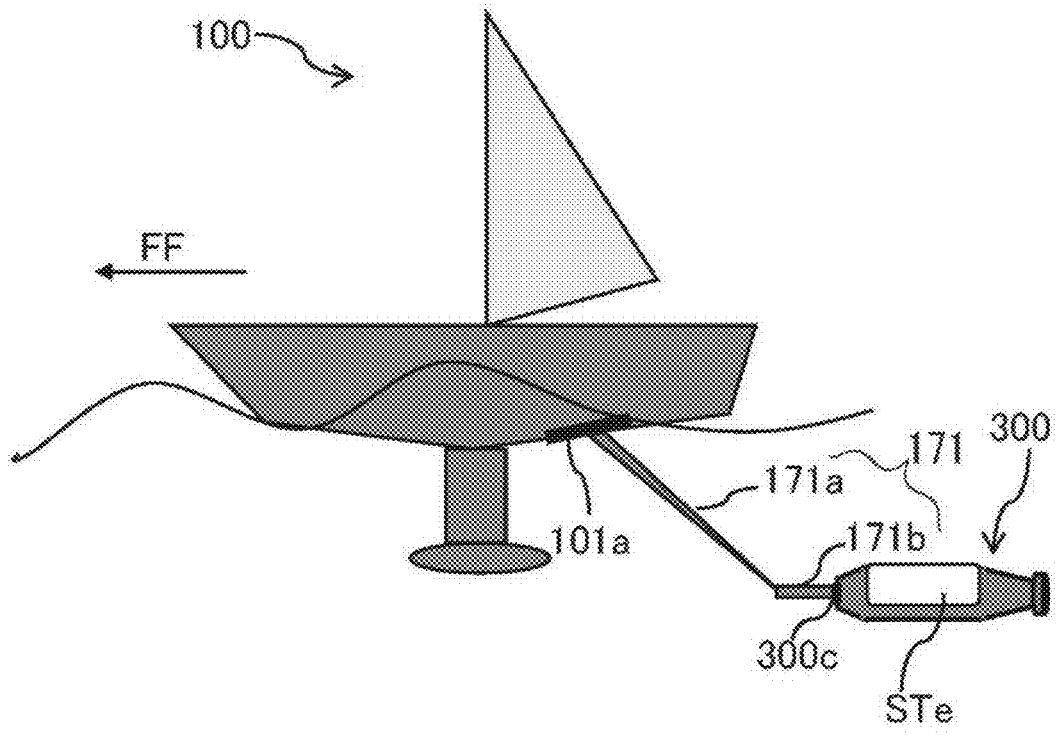
FIG. 10B is a view illustrating a state in which a drawer joint and an underwater navigation body are connected to each other.
Figure 11A:
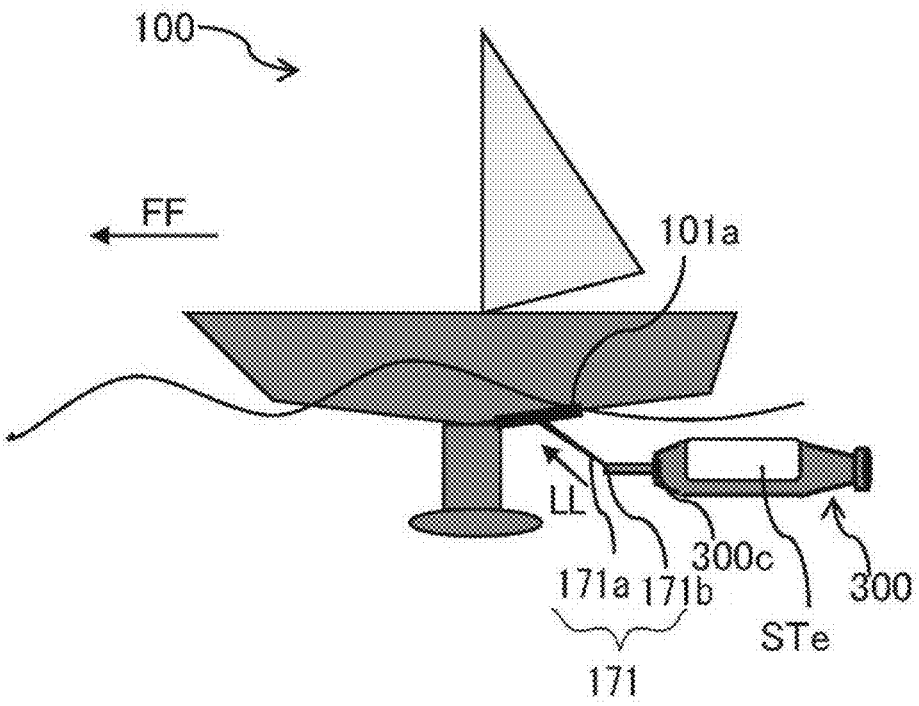
FIG. 11A shows an underwater navigation body pulled up by drawer joints.

For example, when the navigation body connection portion 171*b* of the pull-up joint 171 contacts the docking portion 300*c* of the underwater navigation body 300, the navigation body control unit 360 may connect the docking portion 300*c* to the navigation body connection portion 171*b*. In FIG. 10B, the navigation body connection portion 171*b* of the pull-up joint 171 and the docking portion 300*c* of the underwater navigation body 300 are connected. For example, the navigation body control unit 360 may control opening and closing of the self-opening/closing hook of the docking portion 300*c* to connect the docking portion 300*c* to the eye bolt of the navigation body connection portion 171*b*. For example, the navigation body control unit 360 may connect the docking portion 300*c* to the metallic portion of the navigation body connection portion 171*b* by the magnetic force of the magnet mechanisms of the docking portion 300*c*. When the navigation body connection portion 171*b* and the docking portion 300*c* are connected, the pull-up control unit 161 may contract the flexible arm 171*a* in the longitudinal LL. As a result, as shown in FIG. 11A, the underwater navigation body 300 connected to the navigation body connection portion 171*b* is pulled up toward the power generation floating body 100.

Figure 11B:
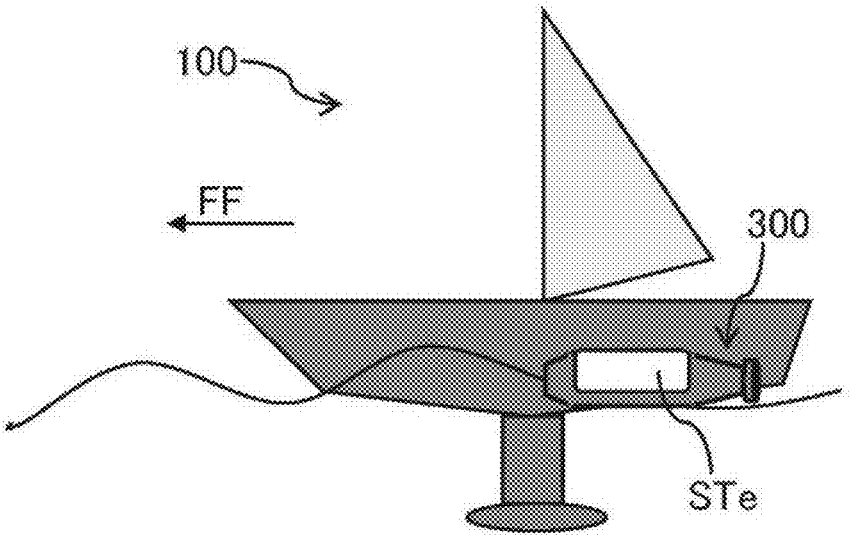
FIG. 11B is a diagram illustrating an underwater navigation body pulled up by a power generation.

By means of the pull-up joints 171, the underwater navigation body 300 fitted with the empty tank STe may ultimately be pulled up into the power generation floating body 100, as shown in FIG. 11B. When the underwater navigation body 300 is pulled up to the power generation floating body 100, for example, the filled tank attachment unit 412 may release the empty tank STe from the tank attachment portion 310. The released empty tank STe may be conveyed to the tank holding portion 141, for example, by means of the tank holding unit 140 and/or a moving device provided in the pull-up unit 170. In addition, the filled tank STf held by the tank holding portion 141 by the moving device may be disposed in the tank attachment portion 310 of the underwater navigation body 300. When the filled tank STf is arranged in the tank attachment portion 310, the filled tank attachment unit 412 may be equipped with the arranged filled tank STf.

The underwater navigation body 300 may, for example, remain connected to the navigation body connection portion 171*b* of the pull-up joint 171 with the docking portion 300*c* even after being pulled up to the power generation floating body 100. After the filled tank STf is attached to the underwater navigation body 300, the pull-up control unit 161 may extend the pull-up joint 171 from the pull-up port 101*a* into the sea, for example, with the underwater navigation body 300 connected thereto. As a result, the underwater navigation body 300 to which the filled tank STf is attached is discharged to the outside of the vessel. When the underwater navigation body 300 is discharged to the outside of the vessel, the navigation body control unit 360 may control the docking portion 300*c* to disconnect the navigation body connection portion 171*b*. For this release, for example, the navigation body control unit 360 may open the self-opening/closing hook of the docking portion 300*c*. For the purpose of the release, for example, the navigation body control unit 360 may stop the magnetic force generation in the magnet mechanisms of the docking portion 300*c*. As a result, the underwater navigation body 300 can begin navigating in the second position 200P. That is, the second navigation unit 422 may initiate a second navigation process (FIG. 6: S16).

The place where the underwater navigation body 300 is ultimately pulled up by the pull-up joint 171 is not limited to the inside of the power generation floating body 100. The place where the underwater navigation body 300 is ultimately pulled up may be the outboard (e.g., the bottom of the ship) of the power generation floating body 100. Here, for example, an arm or the like of a moving device provided in the pull-up unit 170 may extend to the underwater navigation body 300 outside the vessel to carry the storage tank ST.

The flexible arm 171*a* may be provided with, for example, a vibration isolator that prevents vibration caused by waves, ocean currents, or the like. The vibration isolator may be an active vibration isolator with an actuator controllable by the pull-up control unit 161. The vibration isolator may be provided with, for example, a vibration sensor that detects a vibration caused by a wave, an ocean current, or the like. The pull-up control unit 161 may control the actuator of the vibration isolator so as to suppress the swing of the flexible arm 171*a* based on the sensor data from the swing sensor.

Further, the pull-up control unit 161 may stop the vibration isolation by the vibration isolator, for example, by stopping the control instruction to the actuator of the vibration isolator. For example, after the underwater navigation body 300 is connected to the pull-up joint 171 (FIG. 10B and FIG. 11A), the pull-up control unit 161 may stop the control instruction of the actuator. Accordingly, after the underwater navigation body 300 is connected, the pull-up joint 171 can pull up the underwater navigation body 300 without resisting external forces generated by waves, ocean currents, or the like.

In addition to the power generation floating body 100, or in lieu of the power generation floating body 100, the pull-up unit 170 may be located in the transportation vessel 200. In this case, the control unit corresponding to the pull-up control unit 161 may be implemented as a functional block in the transportation vessel control mechanism 240.

ADDITIONAL REMARKS

With regard to the embodiments described above, the following additional notes are further disclosed.

Appendix 1

In the underwater transfer system described in Appendix 1, a 1 position in which a filling storage tank, which is a storage tank filled with a predetermined energy, waits for recovery, and a 2 position, which is a recovery destination of the filling storage tank, is provided. An underwater energy transfer system for moving the storage tank by an underwater navigation body provided with a tank mounting part capable of detaching the storage tank is provided. An attachment control unit for controlling an operation of the tank mounting part and a navigation control part for causing the underwater navigation body to navigate in water, and the attachment control unit is provided. An empty tank attachment unit for mounting an empty storage tank which is a storage tank before the energy is filled in the 2 position, and the underwater navigation body is provided at the 1 position Upon arrival, the empty storage tank is released from the tank attachment portion, and a filled tank attachment unit for mounting the filling storage tank to the tank attachment portion. The navigation control unit includes a first navigation unit that causes the underwater navigation body to travel to the first position with the air storage tank mounted thereon, and a second navigation unit that causes the underwater navigation body to travel to the second position with the filling storage tank mounted thereon.

According to the underwater energy transfer system described in appendix 1, the storage tank is carried by an underwater navigation body navigating underwater. Therefore, the distance between the first position of the filling storage tank to be recovered and the second position of the recovery destination of the filling storage tank and the degree of freedom in setting each position are high. The storage tank is also carried in water. Therefore, according to the underwater energy transfer system, the use of buoyancy reduces the burden on the transfer even when the storage tank is transported with a large weight. In addition, stable energy transfer is realized without being affected by the environment (e.g., wind or waves) on the water surface. Further, according to the underwater energy transfer system, it is possible to recover the filling storage tank held in the first position and replace the filling storage tank held in the first position with an empty storage tank. For example, in the case where the storage tank is filled with energy in the first position, the underwater energy transfer system is particularly effective.

Each of the first position and the second position is a concept including not only one position but also a rational range. In a filled storage tank, the filling rate of energy does not need to be 100%. For example, a predetermined filling rate of energy to be recovered may be filled.

Appendix 2

The underwater energy transfer system described in Appendix 2 is the underwater energy transfer system described in Appendix 1, wherein the first position is a position corresponding to a floating body that floats on a water surface, obtains electrical energy based on wind power, and fills the storage tank with the electrical energy in a predetermined manner, and the second position is a position corresponding to a transport vessel that transports the storage tank.

According to the underwater energy transfer system described in Appendix 2, a storage tank filled with electric energy generated by a floating body can be transferred to a transport vessel. Even when the electric power is generated in the offshore sea, the charge storage tank is transported from the floating body to the transportation vessel in water, so that stable transfer of electric energy can be provided.

Appendix 3

The underwater energy transfer system described in Appendix 3 is an underwater energy transfer system according to Appendix 2, wherein at least one of the floating body and the transport vessel includes a pull-up joint that extends into the water and pulls up the underwater navigation body, the pull-up joint having a navigation body connection portion to which the underwater navigation body is connected, and having a pull-up control unit that pulls up the underwater navigation body when the underwater navigation body is connected to the navigation body connection portion of the pull-up joint.

According to the underwater energy transfer system described in Appendix 3, an underwater navigation body can be connected to a pull-up joint extending underwater to be pulled up to a predetermined position on or under water. The pull-up control unit may be provided, for example, on a floating body and/or a transport vessel provided with a pull-up joint.

Additional Remark 4

The underwater energy transfer system described in Appendix 4 is the underwater energy transfer system according to Appendix 2 or 3, wherein the underwater navigation body further includes a communication unit capable of underwater wireless communication with at least one of the transport vessel and the floating body, and the navigation control unit causes the underwater navigation body to navigate based on the information received by the communication unit.

According to the underwater energy transfer system described in Appendix 4, the underwater navigation body can underwater based on external information by underwater wireless communication. Thus, the underwater navigation body can underwater with external assistance. Therefore, a more stable underwater navigation is realized.

Appendix 5

The underwater energy transfer system described in Appendix 5 is the underwater energy transfer system described in Appendix 4, wherein the navigation control unit moves the underwater navigation body from the empty storage tank to the filled storage tank based on the information received by the communication unit when the empty storage tank is released from the tank mounting unit.

According to the underwater energy transfer system described in Appendix 5, after the empty storage tank is released from the tank mount, the underwater navigation body can move to the filled storage tank based on information from the outside. Therefore, the underwater navigation body can replace the storage tank mounted on the tank attachment portion with support from the outside.

The present disclosure can be modified as appropriate within the scope and spirit of the disclosure which can be read from the claims and the specification as a whole, and an underwater energy transfer system accompanied by such a modification is also included in the technical idea of the present disclosure.

What is claimed is:

1. An underwater energy transfer system configured to move a storage tank by an underwater navigation body including a tank attachment portion to and from which the storage tank is attachable and detachable between a first position where a filled storage tank that is the storage tank filled with predetermined energy waits for collection and a second position where the filled storage tank is to be collected, the underwater energy transfer system comprising:

an attachment control unit configured to control an operation of the tank attachment portion; and a navigation control unit configured to cause the underwater navigation body to navigate underwater, wherein:

the attachment control unit includes an empty tank attachment unit configured to attach, to the tank attachment portion, an empty storage tank that is the storage tank prepared at the second position before being filled with the energy, and a filled tank attachment unit configured to, when the underwater navigation body arrives at the first position, release the empty storage tank from the tank attachment portion and attach the filled storage tank to the tank attachment portion; and the navigation control unit includes a first navigation unit configured to cause the underwater navigation body to which the empty storage tank is attached to navigate to the first position, and a second navigation unit configured to cause the underwater navigation body to which the filled storage tank is attached to navigate to the second position.

2. The underwater energy transfer system according to claim 1, wherein:

the first position is a position corresponding to a floating body configured to float on a water surface, obtain electric energy based on wind power, and fill the storage tank with the electric energy in a predetermined manner; and the second position is a position corresponding to a transport vessel configured to transport the storage tank.

3. The underwater energy transfer system according to claim 2, wherein:

at least either of the floating body and the transport vessel includes a pull-up joint extending underwater and configured to pull up the underwater navigation body;

the pull-up joint includes a navigation body connection portion to which the underwater navigation body is to be connected; and the underwater energy transfer system includes a pull-up control unit configured to pull up the underwater navigation body when the underwater navigation body is connected to the navigation body connection portion of the pull-up joint.

4. The underwater energy transfer system according to claim 2, wherein the underwater navigation body further includes a communication unit configured to perform underwater wireless communication with at least either of the transport vessel and the floating body, and the navigation control unit is configured to cause the underwater navigation body to navigate based on information received by the communication unit.

5. The underwater energy transfer system according to claim 4, wherein the navigation control unit is configured to, when the empty storage tank is released from the tank attachment portion, move the underwater navigation body from the empty storage tank to the filled storage tank based on the information received by the communication unit.

* * * * *